US009603771B1

(12) United States Patent
Alvarez

(10) Patent No.: US 9,603,771 B1
(45) Date of Patent: Mar. 28, 2017

(54) CHEST COMPRESSION DEVICE AND LINEN ATTACHMENT ASSEMBLY FOR CHEST COMPRESSION DEVICE

(71) Applicant: Miguel Alvarez, Lakewood, CA (US)

(72) Inventor: Miguel Alvarez, Lakewood, CA (US)

( * ) Notice: Subject to any disclaimer, the term of this patent is extended or adjusted under 35 U.S.C. 154(b) by 306 days.

(21) Appl. No.: 14/294,234

(22) Filed: Jun. 3, 2014

Related U.S. Application Data

(60) Provisional application No. 61/830,382, filed on Jun. 3, 2013.

(51) Int. Cl.
*A61H 31/00* (2006.01)

(52) U.S. Cl.
CPC ..... *A61H 31/00* (2013.01); *A61H 2205/084* (2013.01)

(58) Field of Classification Search
CPC ..... A47G 9/02; A47G 9/0238; A47G 9/04; A47C 21/02; A47C 21/022; A47C 21/024; Y10T 24/23; A61H 9/0078; A61H 9/0092; A61H 11/00–11/02; A61H 23/04; A61H 31/00; A61H 2031/003; A61H 2201/0103; A61H 2201/0138–2201/0146; A61H 2201/1619–2201/1621; A61H 2201/165; A61H 2201/5056; A61H 2203/0443
See application file for complete search history.

(56) References Cited

U.S. PATENT DOCUMENTS

| | | | | |
|---|---|---|---|---|
| 4,782,543 | A * | 11/1988 | Hutton | A47C 21/022 24/72.5 |
| 4,862,541 | A * | 9/1989 | Hutton | A47G 9/0238 5/496 |
| 5,815,861 | A * | 10/1998 | LaGrange | A47C 21/022 24/72.5 |
| 5,921,845 | A * | 7/1999 | Scholtz | A41F 15/00 2/73 |
| 7,316,658 | B2 | 1/2008 | Gagne | |
| 8,365,361 | B1 * | 2/2013 | Ahern | A47C 21/02 24/338 |
| 2013/0180050 | A1 * | 7/2013 | Koci | A47G 9/02 5/496 |

FOREIGN PATENT DOCUMENTS

EP 2233122 B1 7/2013

* cited by examiner

*Primary Examiner* — Rachel Young
(74) *Attorney, Agent, or Firm* — Hanrahan Law Firm, P.A.; Benjamin M. Hanrahan

(57) ABSTRACT

A chest compression device and a linen attachment assembly for a chest compression device are presented herein. In particular, the chest compression device is connectable to an air pulse generator for performing chest compression therapy or techniques while one or more chest panels are positioned in an overlying relation to the patient's chest. The device includes an attachment assembly disposed on opposite sides thereof and includes one or more connectors attached to the chest panel(s) and a separate grooved anchor. The grooved anchor is positioned under the linen on opposite sides of the patient, the connector attaches to the anchor through the linen, pinching the linen there between.

13 Claims, 8 Drawing Sheets

CHEST COMPRESSION DEVICE AND LINEN ATTACHMENT ASSEMBLY FOR CHEST COMPRESSION DEVICE

CLAIM OF PRIORITY/CROSS REFERENCE TO RELATED APPLICATION

The present application is based on and a claim to priority is made under 35 U.S.C. §119(e) to provisional patent application Ser. No. 61/830,382, having a filing date of Jun. 3, 2013, the contents of which are incorporated herein their entirety.

FIELD OF THE INVENTION

The present invention is generally directed to a chest compression device and a bed linen attachment assembly for attaching the chest compression device to a linen, such as, but not limited to a bed sheet (e.g., a fitted or flat bed sheet), bed covering, etc. In this manner, the chest compression device may be secured in place to the linen on opposite sides of a patient lying in a supine position, with one or more chest panels disposed in an overlying relation to the patient's chest or other body portion.

BACKGROUND OF THE INVENTION

Therapeutic percussion vests or chest compression vests must typically be securely wrapped completely around an individual's body for a close, tight fit against the individual's chest or torso. Once wrapped around the patient's chest or torso, the vest may be attached to an air pulse generator or other device for generating oscillatory air pulses to the vest. This type of therapy can be used to produce vibrations on the patient's chest or other areas in an attempt to loosen secretions or mucus.

Oftentimes, however, patients who must undergo percussion, or other like therapy, are sickly, weak or obese and therefore have difficulty sitting up or positioning his or her body in a manner that would allow the vest to be wrapped around the body or chest. In such instances, two or more therapists or caregivers are often required to assist the patient in order to position the patient's body in an appropriate manner allowing for the vest to be wrapped around the patient's chest or torso. If additional help or assistance from other therapists or caregivers is not readily available, then treatment must either be postponed or, in the worst case, cancelled all together.

After treatment, the vest must be removed. Again, however, if the patient is sickly, weak or obese, for example, or otherwise cannot sit up or struggles to sit up without assistance, removal of the vest can be difficult. This process is, therefore, quite time consuming, rather difficult and physically exhausting, and oftentimes painful or uncomfortable for the patient, as well as the therapist(s) and caregiver(s).

Accordingly, there is a need in the art for a chest compression device that can be positioned on the patient without having to move the patient or require the patient to sit up, particularly in the event the patient is sickly, weak or obese. In particular, the proposed device and/or attachment assembly may be structured to securely attach to the bed linen(s) or other sheet-like device positioned underneath the patient and accessible on opposite sides of the patient. For instance, one end of the device may attach to a bed sheet on one side of the patient and the other end of the device may attach to the bed sheet on the other side of the patient. With the patient lying on top of the bed sheet, and the device secured to the bed sheet on opposite sides of the patient, the device may be positioned in an overlying, secure manner to the patient's chest or other body portion for treatment. In this manner, the device need not be wrapped completely around the patient's torso, and thus, use of the device of certain embodiments does not require the patient to sit up.

SUMMARY OF THE INVENTION

The present invention is directed to a chest compression device and an attachment assembly for attaching the chest compression device to a bed sheet or other linen. The chest compression device may be structured to quickly inflate and deflate in order to provide percussion therapy to the patient. Particularly, the attachment assembly of certain embodiments includes one or more connectors attached to the chest compression device, and a separate anchor, allowing the chest compression device to be positioned over the top of a patient lying down (e.g., in a supine position), without requiring the patient to sit up.

For example, when the patient is lying down, the chest compression device may be positioned over the patient's chest with the attachment assemblies disposed on opposite sides of the patient. The anchor of the attachment assembly may be disposed on one side of the bed linen (e.g., underneath the bed linen or between the bed and bed linen). The connector attached to the chest compression device may then secure to or otherwise engage the anchor from the other side of the bed linen (e.g., on top of the bed linen, immediately next to or adjacent the patient). In this manner, the connector will push the bed linen into a groove on the anchor and embed or pinch the bed linen between the connector and the anchor. This provides a secure attachment between the chest compression device and the bed or linen without requiring the patient to sit up or otherwise maneuver his or her body.

In certain embodiments, the connector includes a rigid hook with a rounded or U-shaped configuration cooperatively structured to fit within the corresponding groove on the anchor. A rubber or other gripped coating may be included on the end of the hook to facilitate a secure engagement between the connector and the anchor, with the bed linen disposed or engaged there between.

Further embodiments of the connector may include an extended tether which can be looped around or removably engaged with the groove of the anchor. The tether may include a flexible construction allowing for the tether to be wrapped around the anchor multiple times for added strength or for adjusting the length, as desired or as needed. It should be noted that certain embodiments may include both the hook and the extended tether for selective engagement with the anchor. For example, the hook may be used in certain instances, although if the patient is particularly obese, the extended tether may need to be used to provide added length. Of course, the hook may be used on one side and the tether on the other side, or the hook on both sides, or the tether on both sides.

It should also be noted that in certain embodiments of the present invention, size of the groove and/or connector (e.g., the hook and/or the tether) may vary depending on the size or thickness of the sheet or linen, for example.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
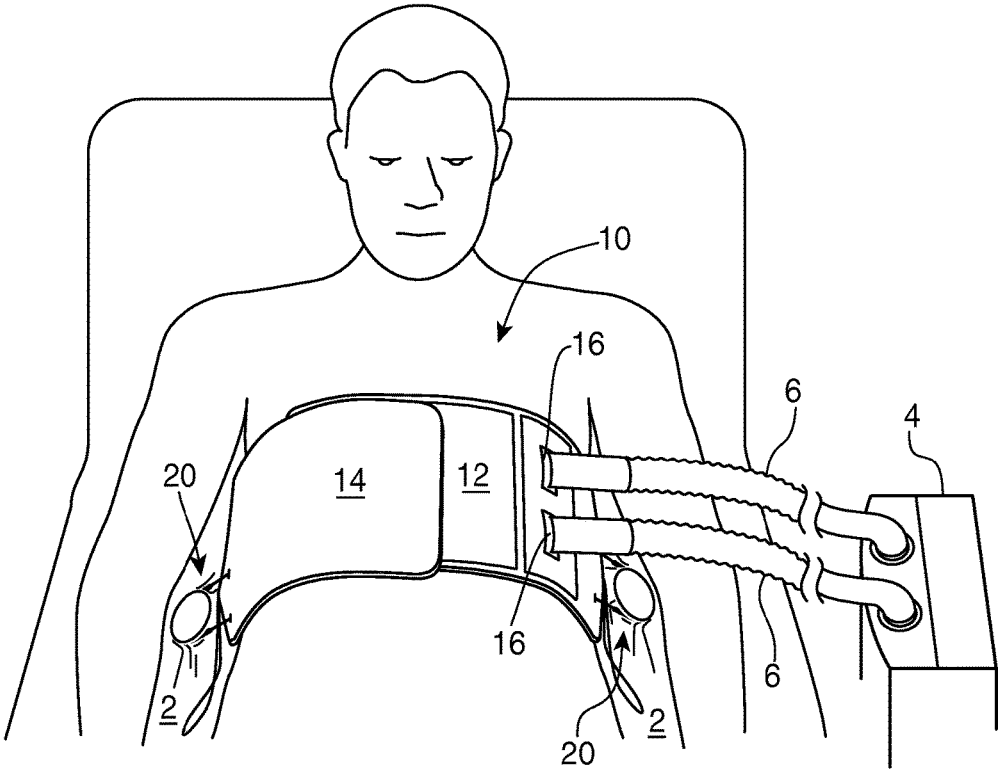
FIG. 1 is a perspective view of the chest compression device disclosed in accordance with at least one embodiment of the present invention disposed in an overlying relation to a patient's chest and attached to a linen.

As shown in the accompanying drawings, and with particular reference to FIG. 1, the present invention is directed to a chest compression device 10 and one or more attachment assemblies 20 for securely attaching the chest compression device 10 to a bed, for example, via attachment to linen 2, such as a bed sheet. Particularly, the chest compression device 10 may include at least one chest panel 12, 14 disposed in an at least partially covering or overlying relation to a patient's chest. During operation, the chest compression device 10 may be connected to an air pulse generator 4 via one or more hoses 6 in order to perform chest compression and/or percussion treatment on the patient. For example, the percussion treatment may include a series of air pulses or oscillatory generation of air to and from the chest panel(s) 12, 14 and/or chest compression device 10 for inflating and deflating a bladder or bag. Such a procedure may help remove secretions from the patient's lungs in that the vibrations caused by the oscillatory air pulses can loosen the secretions in the patient's lungs or chest. Other benefits and/or therapeutic effects may be generated via the use of percussion therapy or chest compressions.

It should be noted that certain embodiments of the present invention are directed to a chest compression device 10 and/or attachment assembly 20 for securing the chest compression device 10 to a bed linen 2, which is particularly useful, but not necessarily limited to, cases in which the patient is unable to sit up, struggles to sit up without the help from a therapist (or other caregiver), is weak, obese, etc. Particularly, in such cases, the patient may not be able to easily wrap a conventional chest compression vest completely around his or her chest or upper body. Accordingly, as will be apparent from the description provided herein, the one or more attachment assemblies 20 described in accordance with the various embodiments are structured to secure the chest compression device 10 to a bed sheet or other linen 2 on opposite sides of the patient. This allows the chest compression device 10 to span across the patient's chest while remaining securely in place during the percussion, compression, or other treatment.

Figure 2:
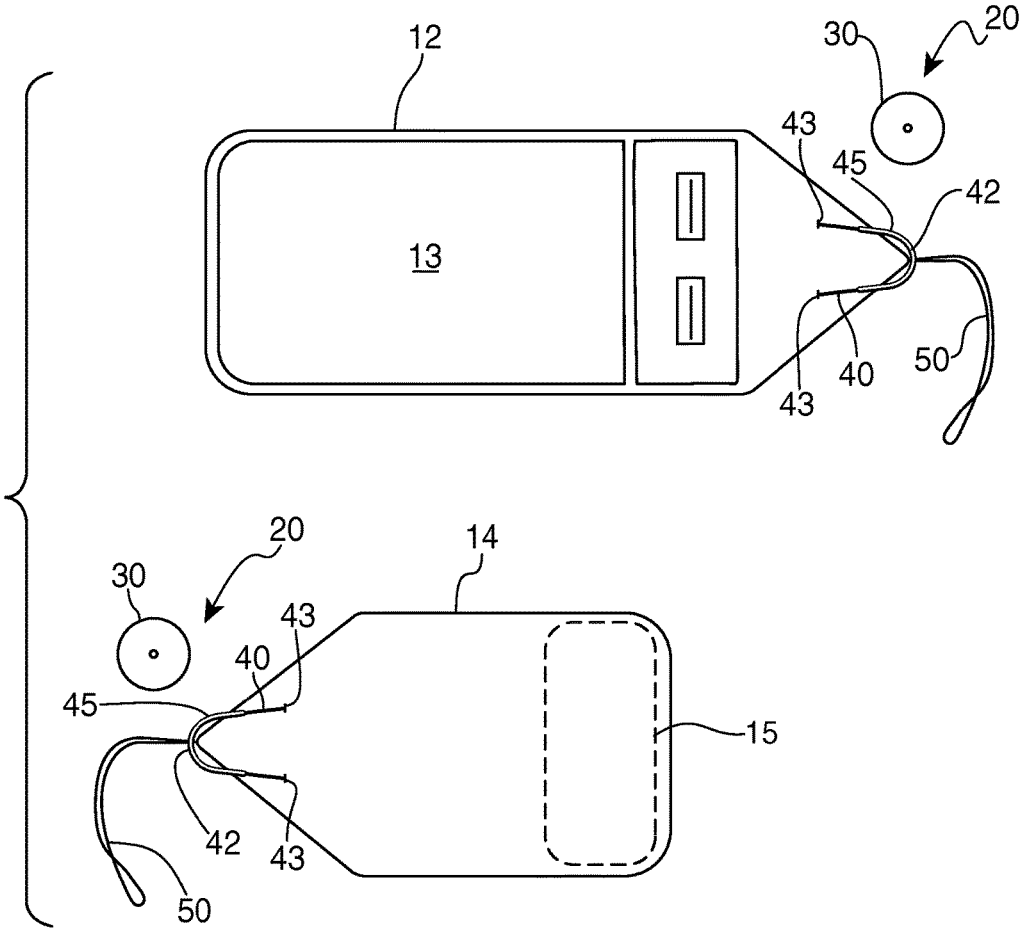
FIG. 2 is a top view of the components of the chest compression assembly disclosed in accordance with at least one embodiment of the present invention.

Particularly, referring now to FIG. 2, the various components of the chest compression device 10 of at least one embodiment are shown. For example, in this illustrated embodiment, the chest compression device 10 includes two separated panels 12, 14, each including an attachment assembly 20 secured to an end thereof. As will be described herein, the attachment assemblies 20 may first be secured to the bed linen underneath and on opposite sides of the patient. The two panels 12, 14 may then be joined together via connection devices 13, 14 over the patient's chest or other body portion. As shown, the connection devices 13, 14 include hook and loop type fasteners, such as VELCRO®, although virtually any connection devices may be implemented in order to connect the two panels 12, 14 to one another, such as, but not limited to, snap connectors, buttons, belt clips or loops, eye hooks, etc. In the exemplary embodiment shown, the first chest panel 12 includes a large hook and loop panel 13 on a top surface thereof, and the second chest panel 14 includes a cooperatively structured hook and loop fastener panel 15 disposed on the bottom surface (shown by dashed lines).

It should also be noted, however, that certain embodiments of the present invention may include a single chest panel with attachment assemblies 20 secured to opposite ends thereof. In such an embodiment, elastic or other material capable of stretching may be used as part of the chest panel to accommodate patients of various sizes.

Still referring to FIG. 2, at least one embodiment of the attachment assembly 20 of the present invention includes an anchor 30 and one or more connectors 40, 50. Specifically, the anchor 30 is secured or disposed on a first side of the linen 2 (e.g., under the linen), and one of the connectors 40, 50 is secured to the anchor 30 on the other side of the linen 2 (e.g., top surface) in order to pinch or engage the linen 2 there between.

Figure 3A:
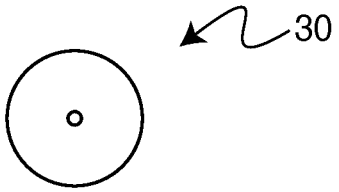
FIG. 3A is a top view of the anchor as provided in accordance with at least one embodiment disclosed herein.
Figure 3B:
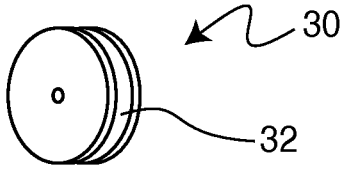
FIG. 3B is a perspective view of the anchor illustrated in FIG. 3A.
Figure 3C:
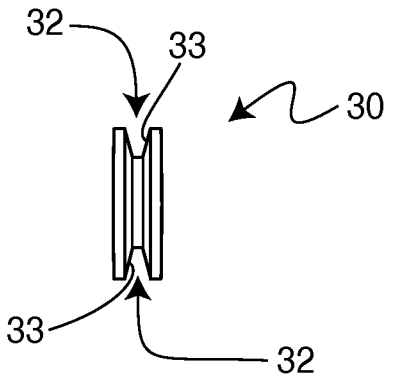
FIG. 3C is a side view of the anchor illustrated in FIGS. 3A and 3B.

For example, as shown in FIGS. 3A, 3B and 3C, the anchor 30 of at least one embodiment comprises a rounded or disc-like configuration with a groove 32 disposed at least partially (and in the illustrated embodiment, completely) around the outer periphery thereof. Other shapes may be implemented, as well, and thus anchor 30 should not be limited to a rounded disc-like configuration as shown in the illustrated example. In any event, the groove 32 is structured to receive a portion of the bed sheet or other linen therein while the connector 40, 50 pinches or securely disposes the linen by engagement with the anchor 30 through the linen. The width and depth of the groove 32 may vary depending on the thickness of the linen for example. However, the connector 40, 50 is cooperatively structured and dimensioned to at least partially fit within the groove 32 in order to securely hold the linen therein during the percussion or other therapy using the chest compression device 10.

Furthermore, as shown in FIG. 3C, the groove 32 of at least one embodiment may include a converging or V-shaped configuration in that the outer, peripheral opening or end may include a larger dimension than the inner end or portion. In this manner, the inner side walls 33 defining the groove 32 may be angled inward creating the larger outer peripheral opening and the smaller inner end of the converging configuration. Such a configuration may be useful to operatively engage or pinch the linen therein between the side walls 33, inner end and connector 40, 50.

Referring again to FIG. 2, at least one embodiment of the present invention includes a plurality of connectors 40, 50 attached to an end of the chest panel(s) 12, 14 for selective engagement with the anchor 30. Particularly, the plurality of connectors may include a hook connector 40 and an extended tether 50. In particular, certain applications or uses may warrant attaching or engaging the hook 40 with the anchor 30, whereas other applications or uses may warrant attaching or engaging the extended tether 50 to the anchor 30. For example, in cases where the patient is large or obese, the hook(s) 40 may not be long enough to engage the linen 2 on both sides of the patient. In such a case, the extension tether 50 may be used on one or both sides in order to allow for added range or added length. Certain applications may include use of the hook connector 40 on one side of the patient and use of the extended tether 50 on the other side of the patient. It should also be noted, however, that other connectors, including adjustable connectors, or additional connectors, may be used and implemented within the full spirit and scope of the present invention.

More in particular, the hook connector 40 of at least one embodiment may include a generally curved connection or vertex end 42 structured to engage with or connect to the anchor 30 through the linen 2, as described herein. For example, the curved portion of the connection or vertex end 42 is cooperatively structured to fit at least partially within the groove 32 of the anchor 30. In such a manner the radius at the connection end 42 may be similar in dimension, albeit slightly larger, than the radius of the inner end or portion of the groove 32. This allows a secure and tight cooperative engagement between the connection or vertex end 42 of the hook 40 and the groove 32 of the anchor 30, with the linen 2 pinched or engaged there between.

Further embodiments of the hook connector 40 may include a general U-shaped configuration. It should be noted that the U-shaped configuration of at least one embodiment may include a converging configuration from a larger open end 43 (i.e., the end connected to the chest panel 12, 14) to a smaller connection or vertex end 42. Particularly, the larger open end 43 may be similar in size and dimension to the size and dimension of the anchor 30. This allows the user (e.g., therapist or other caregiver) to easily insert the anchor 30 into the hook connector 40 near the open end 43 and slide the connector 40 or anchor 30 to engage the connection or vertex end 42 with the inner end of the groove 32, with the linen 2 disposed there between.

Certain embodiments of the hook connector 40 include a generally rigid material, such as metal or rigid plastic, for example, although other materials may be used. The connection or vertex end 42 of the hook connector 40 may include a gripped coating or gripped portion 45, such as rubber or other like material, to facilitate a gripped engagement with the linen 2 while the linen is securely engaged between the anchor 30 and the connector 40.

The other connector of at least one embodiment, such as the extended tether 50 may include a length longer than the hook connector 40 in order to facilitate an extended connection when needed, as described above. Accordingly, the extended tether 50 may include a generally flexible configuration allowing the extended tether 50 to be looped around the anchor 30 and into the groove 32, of course, while the linen is engaged there between. The extended tether 50 may thus be a rope, string, series of ropes or strings, etc. structured to facilitate implementation of the present invention in the intended manner. If desired, the extended tether 50 may be looped around the anchor 30 and into the groove 32 multiple times for adjusting the length thereof and/or for added strength and securement.

Figure 4:
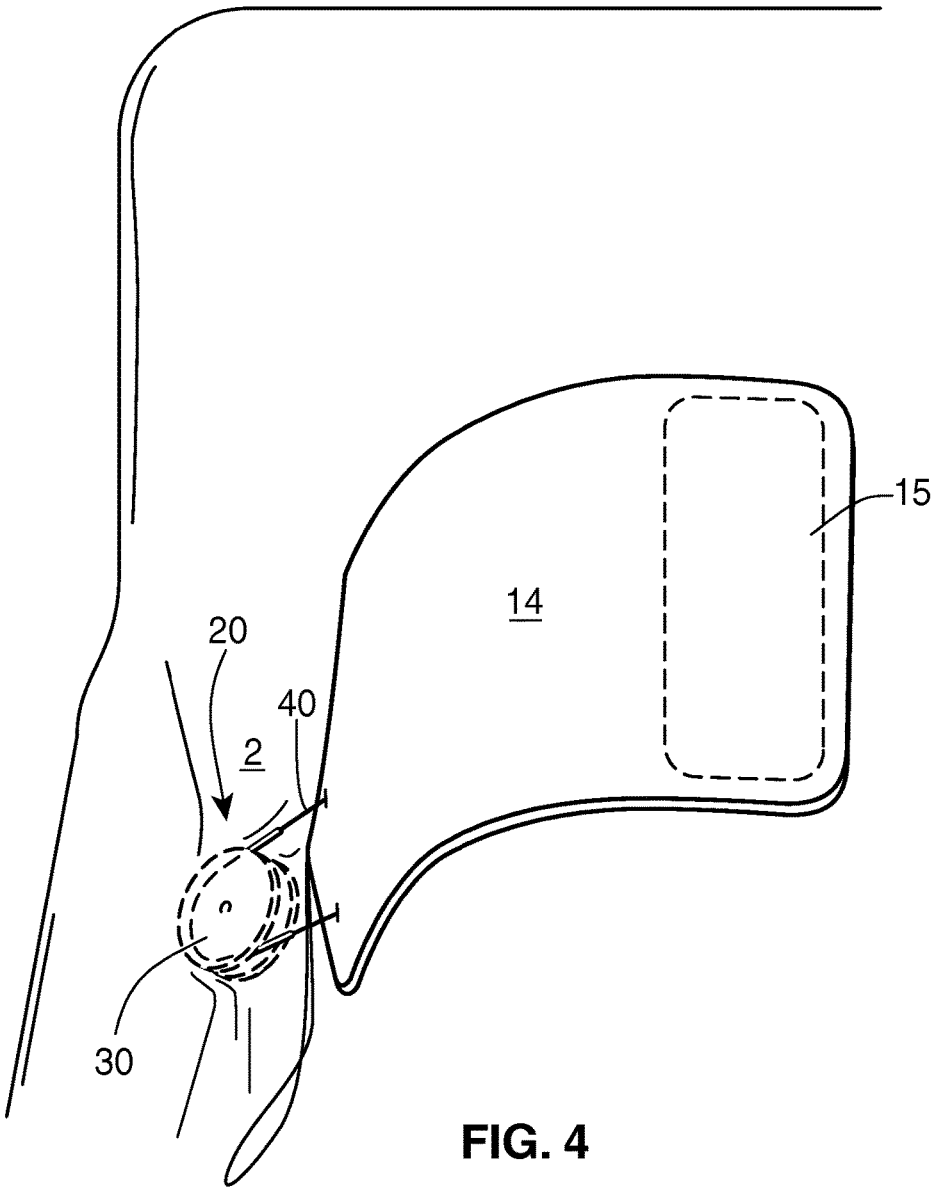
FIG. 4 is a close-up view of the attachment assembly disclosed in accordance with at least one embodiment of the present invention.

As an example, FIG. 4 illustrates a close-up view of the hook connector 40 disposed in an engaged relation with the anchor 30. In this illustration, the anchor 30 is provided in dashed lines because the anchor 30 is disposed underneath the linen 2, or on the bottom side of the linen 2. Particularly, as a first step, the anchor 30 may be placed under the linen 2. Next, engagement of the hook connector 40 from the top surface of the linen thereby securely engages the linen 2 within the groove of the anchor 30 and between the anchor 30 and the connector 40. It should be noted that instead of using the hook connector 40, the extended tether 50 could be used to engage the linen between the tether 50 and the anchor 30.

Figure 5:
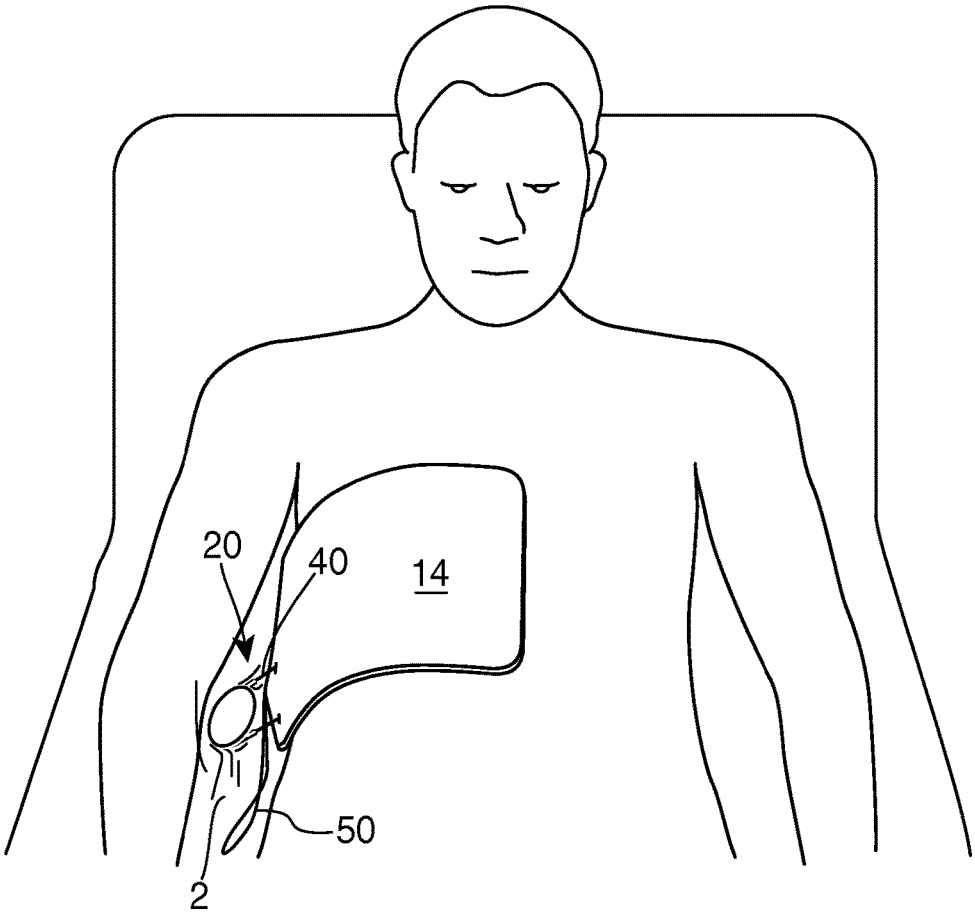
FIG. 5 is a front perspective view of one chest panel and attachment assembly of at least one embodiment.
Figure 6:
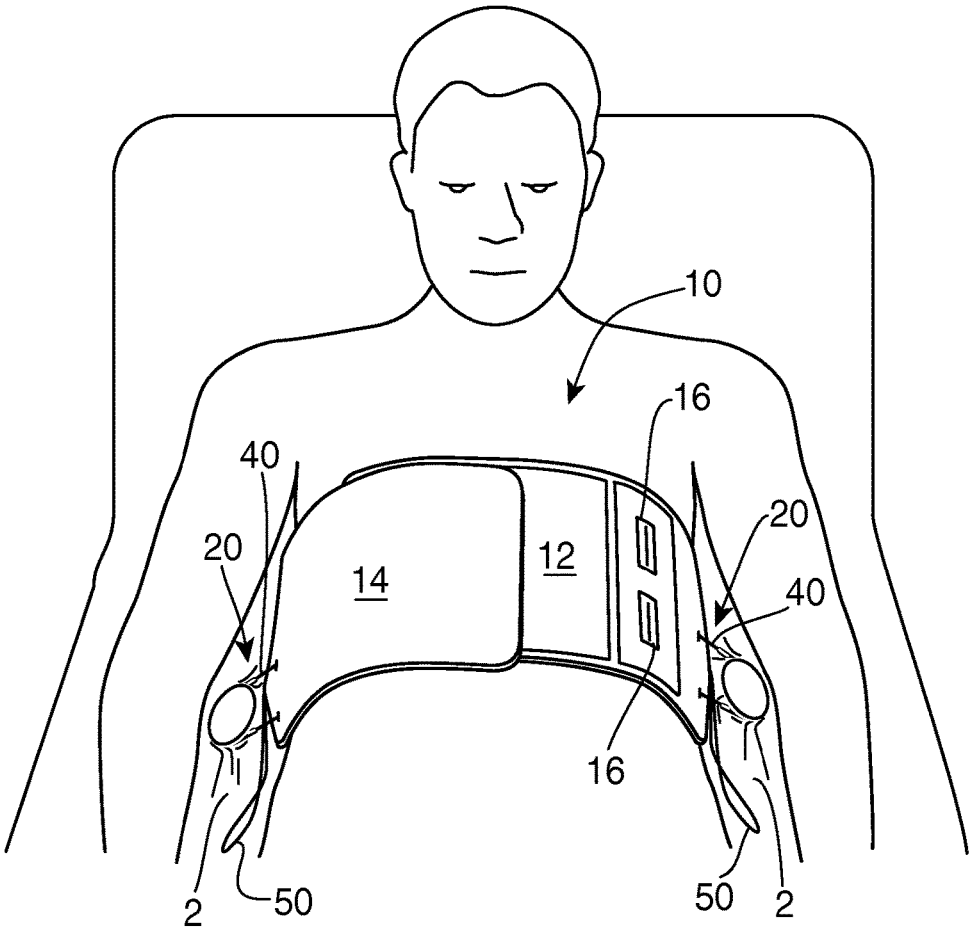
FIG. 6 is a front perspective view of the two chest panels and corresponding attachment assemblies of at least one embodiment using a hook connector.

Referring now to FIGS. 5 and 6, the method or procedure of connecting the chest compression device 10 of at least one embodiment to a linen 2 and disposing the chest compression device 10 in an overlying relation to a patient's chest for performing percussive or other therapy is shown. For example, in FIG. 5, one chest panel 14 is secured to one side of the patient via attachment assembly 20. In this illustrated embodiment, the linen 2 includes a bed sheet that is disposed underneath the patient while the patient is in a supine position. For instance, the patient is lying on his or her back on the bed or other surface with the linen disposed underneath the patient's body, with accessible portions of the bed sheet on both sides of the patient. In this regard, the weight of the patient may be used to facilitate a secure connection of the chest compression device 10 in a taught manner over the patient's chest. The linen 2 may thus be said to include a bed sheet such as a fitted bed sheet, flat bed sheet, etc. However, other sheet-like materials or products, such as, towels, for example, may be used. It should also be noted that certain embodiments may use one or more linens that is/are secured in another manner, other than or in addition to the patient's own weight. For example, the linen may be secured under the mattress, to the side of a hospital or therapy bed, etc. in addition to or instead of being disposed under the patient.

In FIG. 6, the second chest panel 12 is secured to the linen 2 via the corresponding attachment assembly 20, and the two chest panels 12, 14 are secured to one another, for example, via hook and loop or other fasteners. In the example illustrated in FIGS. 5 and 6, the hook connectors 40 are used to secure the chest panels 12, 14 to the linen 2 or anchor 30 (under the linen 2). It should be apparent that the extended tether 50 may be used instead of the hook connector 40 on one or both sides, as desired or as needed, depending on, for example, the size of the patient, the thickness of the linen 2, etc. For instance, FIG. 7 illustrates an application wherein both sides of the chest compression device 10 are secured to the linen 2 and/or anchor 30 via the extended tether 50.

Figure 7:
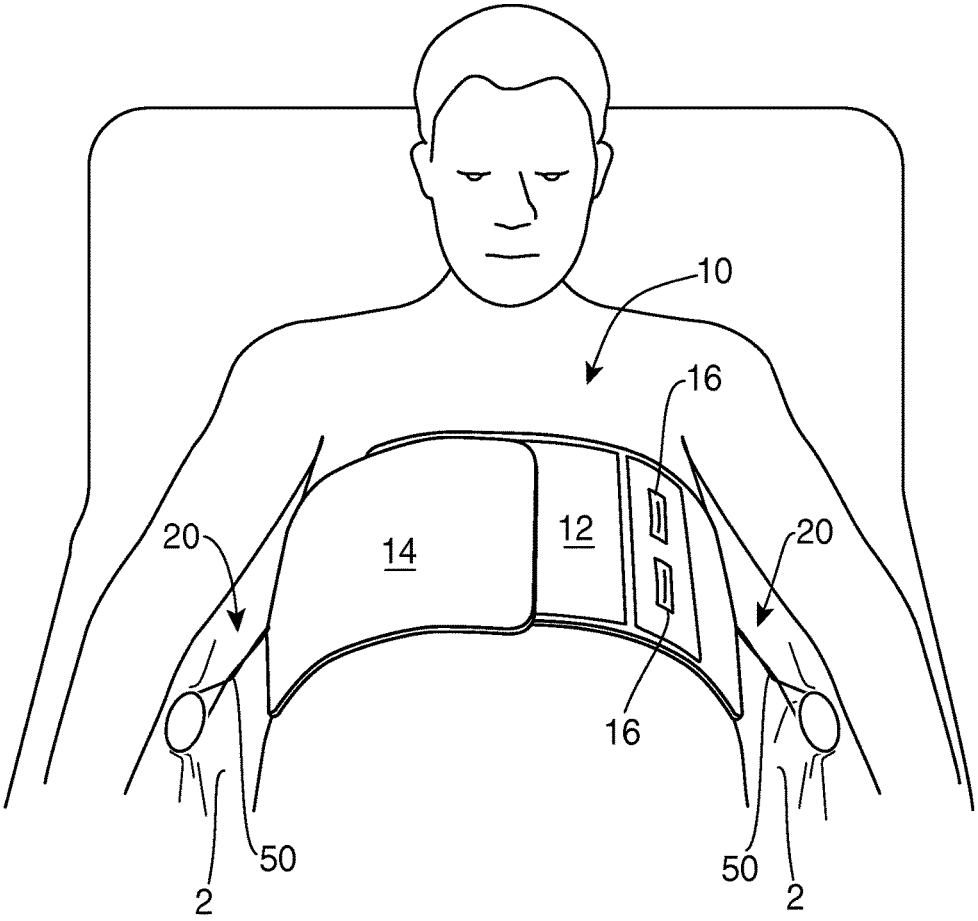
FIG. 7 is a front perspective view of the two chest panels and corresponding attachment assemblies of at least one embodiment using an extended tether connector.

With the chest compression device 10 secured in place (as shown in FIGS. 6 and 7), the chest compression device 10 may be attached to an external device, such as an air pulse generator 4 via one or more hoses 6, as shown in FIG. 1, for example. The hoses 6 may secure to the chest compression device 10 in virtually any manner, such as via connection ports 16. With the chest compression device 10 connected to the air pulse generator 4, and securely disposed in an overlying relation to the patient's chest, chest compression or percussive therapy may be performed, as desired.

Figure 8:
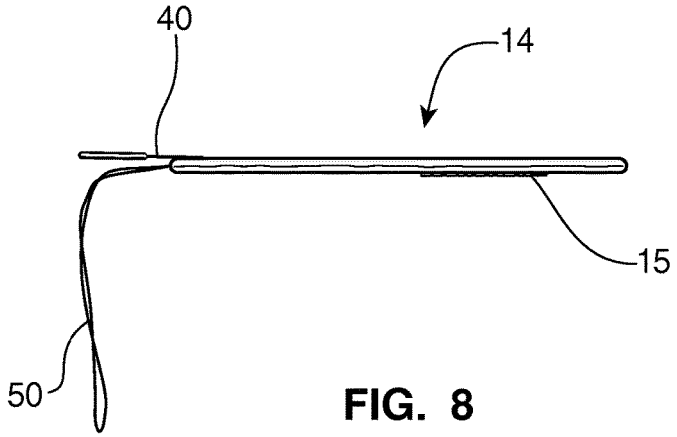
FIG. 8 is a side view of one chest panel of the chest compression device of at least one embodiment of the present invention.
Figure 9:
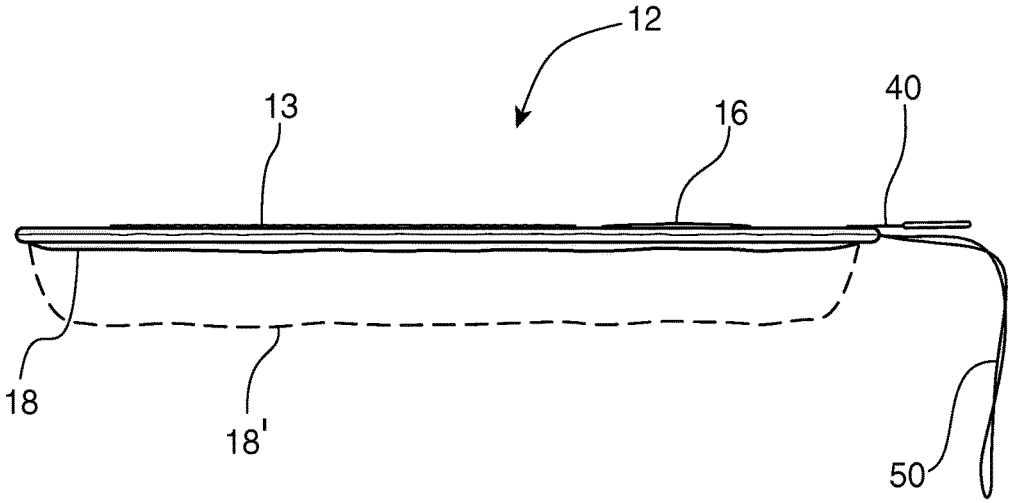
FIG. 9 is a side view of another chest panel of the chest compression device of at least one embodiment of the present invention.

For example, FIGS. 8 and 9 illustrate side profile views of the chest panels 12, 14. As shown, at least one of the panels 12 (particularly the panel(s) that connect to the hose(s) 6), include an inflatable bladder 18, 18' which is structured to inflate, as shown by dashed lines 18' and deflate, as shown at reference character 18, during the chest compression therapy. The oscillatory inflation and deflation therapy is structured to generate vibrations in the patient's chest to loosen secretions, for example.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A chest compression device connectable to an air pulse generator for performing chest compression therapy, said chest compression device comprising:

at least one chest panel adapted to be disposed in an at least partially covering relation to a patient's chest, at least one attachment assembly connected to said at least one chest panel for securing said at least one chest panel to a bed linen, and said at least one attachment assembly comprising:

an anchor disposed on a first surface of the bed linen, a plurality of connectors attached to said at least one chest panel, said plurality of connectors being disposed on a second surface of the bed linen and wherein one of said plurality of connectors is disposed in a selective engaged relation with said anchor, wherein the bed linen is securely disposed between said anchor and said one of said plurality of connectors, wherein said anchor comprises a rounded disc and a groove disposed around an outer periphery of said rounded disc, said groove being cooperatively structured to receive a portion of the bed linen and a portion of said one of said plurality of connectors therein, and said plurality of connectors comprise a U-shaped hook disposable within said groove of said anchor and an extended tether, said extended tether comprising a length longer than said U-shaped hook, wherein said extended tether is attached to said at least one chest panel and disposable in an engaged relation with said anchor.

2. The chest compression device as recited in claim 1 wherein said groove comprises a converging configuration from a larger open peripheral end to a smaller inner end.

3. The chest compression device as recited in claim 1 wherein said at least one connector comprises a converging U-shaped configuration from a larger open end to a smaller vertex end.

4. The chest compression device as recited in claim 3 wherein said at least one connector comprises a rigid material and a gripped coating on said smaller vertex end.

5. The chest compression device as recited in claim 1 wherein said extended tether comprises a flexible looped configuration cooperatively structured for secure disposition within said groove of said anchor while simultaneously engaging the bed linen between said extended tether and said groove.

6. The chest compression device as recited in claim 5 wherein said at least one attachment assembly comprises two attachment assemblies, wherein one of said two attachment assemblies is disposed on one end of said chest compression device and another one of said two attachment assemblies is disposed on an opposite end of said chest compression device.

7. The chest compression device as recited in claim 6 wherein said at least one chest panel comprises two separate chest panels, wherein each of said two separate chest panels comprises a different one of said two attachment assemblies.

8. The chest compression device as recited in claim 7 wherein said two attachment assemblies are adapted to be disposed in an engaged relation with the bed linen on opposite sides of the patient, the patient being in a supine position, and wherein said two separate chest panels are adapted to be secured to one another in an at least partially overlying relation to the patient's chest.

9. An attachment assembly for securing a chest compression device to a linen and in an at least partially overlying relation to a portion of a person's chest while the person is lying in a supine position, said attachment assembly comprising:

an anchor disposed on an undersurface of the linen, and a plurality of connectors attached to an end of the chest compression device, said plurality of connectors being disposed on a top surface of the linen and wherein one of said plurality of connectors is disposed in a selective engagement with said anchor, wherein the linen is securely disposed between said anchor and said one of said plurality of connectors, said anchor comprising a peripheral groove cooperatively structured to receive a portion of the linen and a portion of said one of said plurality of connectors therein.

10. The attachment assembly as recited in claim 9 wherein at least one of said plurality of connectors comprises a U-shaped hook, and a different one of said plurality of connectors comprises an extended tether.

11. The attachment assembly as recited in claim 10 wherein said U-shaped hook comprises a rigid material with a gripping portion disposed at a vertex end.

12. The attachment assembly as recited in claim 11 wherein said extension tether comprises a flexible looped configuration with a length greater than a length of said U-shaped hook.

13. The attachment assembly as recited in claim 12 wherein said peripheral groove of said anchor comprises a converging configuration from a larger open peripheral end to a smaller inner end.

* * * * *